United States Patent [19]

Llenado et al.

[11] Patent Number: 4,483,779

[45] Date of Patent: Nov. 20, 1984

[54] DETERGENT COMPOSITIONS COMPRISING POLYGLYCOSIDE AND POLYETHOXYLATE SURFACTANTS AND ANIONIC FLUORESCER

[75] Inventors: Ramon A. Llenado, West Chester; Denzel A. Nicholson, Cincinnati, both of Ohio

[73] Assignee: The Procter & Gamble Company, Cincinnati, Ohio

[21] Appl. No.: 503,935

[22] Filed: Jun. 13, 1983

Related U.S. Application Data

[63] Continuation-in-part of Ser. No. 371,692, Apr. 26, 1982, , which is a continuation-in-part of Ser. No. 306,562, Sep. 28, 1981, abandoned.

[51] Int. Cl.[3] ..... C11D 3/22; C11D 3/42

[52] U.S. Cl. ..... 252/135; 252/174.17; 252/174.21; 252/174.23; 252/175.25; 252/542

[58] Field of Search ..... 252/89.1, 135, 174.21, 252/174.22, 174.17, 351, 352, DIG. 1; 536/4, 120

[56] References Cited

U.S. PATENT DOCUMENTS

| | | | |
|---|---|---|---|
| 2,049,758 | 8/1936 | Bertsch et al. | 536/4.1 |
| 2,390,507 | 12/1945 | Cantor | 536/4.1 |
| 2,671,780 | 3/1954 | Gaver et al. | 536/111 |
| 2,671,781 | 3/1954 | Gaver et al. | 536/111 |
| 2,959,500 | 11/1960 | Schlapfer et al. | 127/37 |
| 2,974,134 | 3/1961 | Pollitzer | 536/120 |
| 3,092,618 | 6/1963 | Rosen et al. | 536/103 |
| 3,219,656 | 11/1965 | Boettner | 536/18.3 |
| 3,314,936 | 4/1967 | Ames | 536/120 |
| 3,346,558 | 10/1967 | Roth | 536/18.6 |
| 3,450,690 | 6/1969 | Gibbons et al. | 536/18.5 |
| 3,547,828 | 12/1970 | Mansfield et al. | 252/351 |
| 3,598,865 | 8/1971 | Lew | 536/4.1 |
| 3,640,998 | 2/1972 | Mansfield et al. | 536/18.3 |
| 3,707,535 | 12/1972 | Lew | 536/18.6 |
| 3,721,633 | 3/1973 | Ranauto | 252/527 |
| 3,737,426 | 6/1973 | Throckmorton et al. | 536/18.3 |
| 3,772,269 | 11/1973 | Lew | 536/4.1 |
| 3,839,318 | 10/1974 | Mansfield | 536/18.6 |
| 3,927,970 | 12/1975 | Ciko et al. | 8/137 |
| 3,953,380 | 4/1976 | Sundby | 252/543 |
| 4,011,389 | 3/1977 | Langdon | 536/4.1 |
| 4,014,808 | 3/1977 | Herpers et al. | 252/135 |
| 4,154,706 | 5/1979 | Kenkare et al. | 252/547 |
| 4,187,121 | 2/1980 | Herald et al. | 134/26 |
| 4,202,800 | 5/1980 | Ciko et al. | 252/543 |
| 4,223,129 | 9/1980 | Roth et al. | 536/18.6 |
| 4,233,167 | 11/1980 | Sramek | 252/8.75 |
| 4,240,921 | 12/1980 | Kaniecki | 252/156 |
| 4,309,447 | 1/1982 | Tsutsumi et al. | 424/361 |
| 4,379,080 | 4/1983 | Murphy | 252/526 |

FOREIGN PATENT DOCUMENTS

| | | |
|---|---|---|
| 593422 | 2/1934 | Fed. Rep. of Germany . |
| 3001064 | 7/1981 | Fed. Rep. of Germany . |

OTHER PUBLICATIONS

The Journal of The American Chemical Society, vol. 60, (Sep. 1938), pp. 2076–2077, Noller et al.

Nature, vol. 197, (Mar. 16, 1963), Schram et al.

Several Data Sheets: Rohm & Haas Co., Material Safety Data Sheet, Coded 6–1843; a page entitled "Manufacturing Specifications, Triton BG–10"; A Specialty Chemicals Price List, schedule CS–429,25; a publication entitled The Qualitative and Quantitative Determination of Triton BG–10 in Bottle Washing Formulations, Coded CS–400.

The Journal of The American Oil Chemist's Society, vol. 47, #5, (May 1980), pp. 162–167, Hughes et al, "Physical and Functional Properties of Some Higher Alkyl Polyglucosides".

*Primary Examiner*—Prince E. Willis

*Attorney, Agent, or Firm*—Robert B. Aylor; Richard C. Witte; Thomas H. O'Flaherty

[57] ABSTRACT

Detergent surfactant combinations comprising alkylpolyglycoside detergent surfactants and nonionic detergent surfactants provide good detergency and are compatible with anionic optical brighteners, both in built and unbuilt detergent compositions.

9 Claims, No Drawings

DETERGENT COMPOSITIONS COMPRISING POLYGLYCOSIDE AND POLYETHOXYLATE SURFACTANTS AND ANIONIC FLUORESCER

CROSS REFERENCE TO RELATED APPLICATION

This is a continuation-in-part of our copending application, Ser. No. 371,692, filed Apr. 26, 1982, which in turn is a continuation-in-part of our Ser. No. 306,562, filed Sept. 28, 1981, now abandoned.

FIELD OF THE INVENTION

This invention relates to surfactant combinations which provide good detergency and, optionally, good fluorescer effectiveness and/or suds control and/or corrosion inhibition in a laundry context. Such compositions can be either built or unbuilt, granular or liquid, and can contain the usual auxiliary ingredients common to such compositions.

DESCRIPTION OF THE PRIOR ART

Alkylpolyglycosides which are surfactants have been disclosed in U.S. Pat. Nos. 3,598,865; 3,721,633; and 3,772,269. These patents also disclose processes for making alkylpolyglycoside surfactants and built liquid detergent compositions containing these surfactants. U.S. Pat. No. 3,219,656 discloses alkylmonoglucosides and suggests their utility as foam stabilizers for other surfactants. Various polyglycoside surfactant structures and processes for making them are disclosed in U.S. Pat. Nos. 3,640,998; 3,839,318; 3,314,936; 3,346,558; 4,011,389; 4,223,129. All of the above patents are incorporated herein by reference.

SUMMARY OF THE INVENTION

This invention relates to the discovery of certain combinations of surfactants which provide unusually good detergency, especially in cool water, for a variety of fabric types. Specifically this invention relates to detergent compositions comprising:

(1) from about 1% to about 90% of an alkylpolysaccharide detergent surfactant having the formula $$RO(R'O)_y(Z)_x$$

where R is an alkyl, hydroxy alkyl, alkyl phenyl, alkyl benzyl, or mixtures thereof, said alkyl groups containing from about 8 to about 18 carbon atoms; where each R′ contains from 2 to about 4 carbon atoms, preferably an ethoxy, propoxy, or glyceryl group, and y is from 0 to about 12; and where each Z is a moiety derived from a reducing saccharide containing 5 or 6 carbon atoms, and x is a number from about $1\frac{1}{2}$ to about 10;

(2) from about 1% to about 90% of a nonionic detergent surfactant; and (3) from 0% to about 90% of a detergency builder, the ratio of (1) to (2) being from about 1:10 to about 10:1, preferably from about 3:1 to about 1:3.

A highly preferred variation also comprises from about 0.01 to about 2.0% of an anionic fluorescer (optical brightener).

In another highly preferred variation, the nonionic detergent surfactant is selected from the group consisting of amine oxide detergent surfactants, amide detergent surfactants and mixtures thereof, and the composition additionally comprises from about 1% to about 10% of an unsaturated soap containing from about 16 to about 22 carbon atoms, and, preferably, from about 0% to about 10% of a synthetic anionic detergent surfactant.

DESCRIPTION OF THE PREFERRED EMBODIMENTS

The Alkylpolysaccharide Surfactant

It has surprisingly been found that the cosurfactants interact with the alkylpolysaccharide surfactant of this invention to provide good laundry detergency for a wide range of fabrics. The alkylpolysaccharides are those having a hydrophobic group containing from about 6 to about 30 carbon atoms, preferably from about 10 to about 16 carbon atoms and a polysaccharide, e.g., a polyglycoside, hydrophilic group containing from about $1\frac{1}{2}$ to about 10, preferably from about $1\frac{1}{2}$ to about 3, most preferably from about 1.6 to about 2.7 saccharide units. Any reducing saccharide containing 5 or 6 carbon atoms can be used, e.g. glucose, galactose and galactosyl moieties can substitute for the glucosyl moieties. (Optionally the hydrophobic group is attached at the 2, 3, 4 etc. positions thus giving a glucose or galactose as opposed to a glucoside or galactoside.) The intersaccharide bonds can be, e.g., between the one position of the additional saccharide units and the 2-, 3-, 4-, and/or 6 positions on the preceding saccharide units.

Optionally, and less desirably, there can be a polyalkoxide chain joining the hydrophobic moiety and the polysaccharide moiety. The preferred alkoxide is ethylene oxide. Typical hydrophobic groups include alkyl groups, either saturated or unsaturated, branched or unbranched containing from about 8 to about 18, preferably from about 10 to about 16 carbon atoms. Preferably, the alkyl group is a straight chain saturated alkyl group. The alkyl group can contain up to 3 hydroxy groups and/or the polyalkoxide chain can contain up to about 10, preferably less than 5, most preferably 0, alkoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses, and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which said alkyl groups contain from about 10 to about 18, preferably from about 12 to about 14 carbon atoms; n is 2 or 3, preferably 2; t is from 0 to about 10, preferably 0; and x is from $1\frac{1}{2}$ to about 10, preferably from about $1\frac{1}{2}$ to about 3, most preferably from about 1.6 to about 2.7. The glycosyl is preferably derived from glucose. To prepare compounds the alcohol or alkylpolyethoxy alcohol is formed first and then reacted with glucose, or a source of glucose, to form the glucoside (attachment at the 1-position). The additional glycosyl units are attached between their 1-position and the preceding glycosyl units 2-, 3-, 4- and/or 6-position, preferably predominately the 2-position.

Preferably the content of alkylmonoglycoside is low, preferably less than about 60%, more preferably less than about 50%.

Surprisingly, anionic fluorescers which are normally relatively ineffective in the presence of conventional ethoxylated nonionic detergent surfactants at high levels in the absence of substantial levels of anionic detergent surfactants, are very effective when the alkylpolyglycoside surfactants are present. For brightener effectiveness, the ratio of alkylpolyglycoside detergent surfactant to nonionic detergent surfactant should be greater than about 1:4 preferably greater than about 1:3, most preferably greater than about 1:1.

THE NONIONIC DETERGENT SURFACTANT

Nonionic Surfactant

Nonionic surfactants, including those having an HLB of from about 5 to about 17, are well known in the detergency art. They are included in the compositions of the present invention together with the, e.g., alkylpolyglycoside surfactants defined hereinbefore. They may be used singly or in combination with one or more of the preferred alcohol ethoxylate nonionic surfactants, described below, to form nonionic surfactant mixtures useful in combination with the alkylpolyglycosides. Examples of such surfactants are listed in U.S. Pat. No. 3,717,630, Booth, issued Feb. 20, 1973, and U.S. Pat. No. 3,332,880, Kessler et al, issued July 25, 1967, each of which is incorporated herein by reference. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm & Haas Company.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants in this type include Tergitol 15-S-9, marketed by Union Carbide Corporation, Neodol 45-9, Neodol 23-6.5, Neodol 45-7, and Neodol 45-4, marketed by Shell Chemical Company, and Kyro EOB, marketed by The Procter & Gamble Company.

(3) The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

(4) The condensation products of ethylene oxide with the product resulting from the reaction of propylene oxide and ethylenediamine. The hydrophobic moiety of these products consists of the reaction product of ethylenediamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

(5) Semi-polar nonionic detergent surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing ne alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred semi-polar nonionic detergent surfactants are the amine oxide detergent surfactants having the formula $$R^3(OR^4)_xNR_2^5 \rightarrow O$$

wherein $R^3$ is an alkyl, hydroxy alkyl, or alkyl phenyl group or mixtures thereof containing from about 8 to about 22 carbon atoms, $R^4$ is an alkylene or hydroxy alkylene group containing from 2 to 3 carbon atoms or mixtures thereof, x is from 0 to about 3 and each $R^5$ is an alkyl or hydroxy alkyl group containing from 1 to about 3 carbon atoms or a polyethylene oxide group containing from one to about 3 ethylene oxide groups and said R5 groups can be attached to each other, e.g., through an oxygen or nitrogen atom to form a ring structure.

Preferred amine oxide detergent surfactants are $C_{10-18}$ alkyl dimethyl amine oxide, $C_{8-18}$ alkyl dihydroxy ethyl amine oxide, and $C_{8-12}$ alkoxy ethyl dihydroxy ethyl amine oxide.

Nonionic detergent surfactants (1)–(4) are conventional ethoxylated nonionic detergent surfactants.

Preferred alcohol ethoxylate nonionic surfactants for use in the compositions of the present invention are biodegradable and have the formula $$R^8(OC_2H_4)_nOH,$$

wherein $R^8$ is a primary or secondary alkyl chain of from about 8 to about 22, preferably from about 10 to about 20, carbon atoms and n is an average of from about 2 to about 12, particularly from about 2 to about 9. The nonionics have an HLB (hydrophiliclipophilic balance) of from about 5 to about 17, preferably from about 6 to about 15. HLB is defined in detail in *Nonionic Surfactants,* by M. J. Schick, Marcel Dekker, Inc., 1966, pages 606–613, incorporated herein by reference. In preferred nonionic surfactants, n is from 3 to 7. Primary linear alcohol ethoxylates (e.g., alcohol ethoxylates produced from organic alcohols which contain about 20% 2-methyl branched isomers, commercially available from Shell Chemical Company under the tradename Neodol) are preferred from a performance standpoint.

Particularly preferred nonionic surfactants for use in the compositions of the present invention include the condensation product of $C_{10}$ alcohol with 3 moles of ethylene oxide; the condensation product of tallow alcohol with 9 moles of ethylene oxide; the condensation product of coconut alcohol with 5 moles of ethylene oxide; the condensation product of coconut alcohol with 6 moles of ethylene oxide; the condensation product of $C_{12}$ alcohol with 5 moles of ethylene oxide; the condensation product of $C_{12-13}$ alcohol with 6.5 moles of ethylene oxide, and the same condensation product which is stripped so as to remove substantially all lower ethoxylate and nonethoxylated fractions; the condensation product of $C_{12-13}$ alcohol with 2.3 moles of ethylene oxide, and the same condensation product which is stripped so as to remove substantially all lower ethoxylate and nonethoxylated fractions; the condensation product of $C_{12-13}$ alcohol with 9 moles of ethylene oxide; the condensation product of $C_{14-15}$ alcohol with 2.25 moles of ethylene oxide; the condensation product of $C_{14-15}$ alcohol with 4 moles of ethylene oxide; the condensation product of $C_{14-15}$ alcohol with 7 moles of ethylene oxide; and the condensation product of $C_{14-15}$ alcohol with 9 moles of ethylene oxide.

The compositions of the present invention may contain mixtures of the preferred alcohol ethoxylate nonionic surfactants together with other types of nonionic surfactants. One of the preferred nonionic surfactant mixtures contains at least one of the preferred alcohol ethoxylate nonionics, and has a ratio of the preferred alcohol ethoxylate surfactant (or surfactants) to the other nonionic surfactant (or surfactants) of from about 1:1 to about 5:1. Specific examples of surfactant mixtures useful in the present invention include a mixture of the condensation product of $C_{14-15}$ alcohol with 3 moles of ethylene oxide (Neodol 45-3) and the condensation product of $C_{14-15}$ alcohol with 9 moles of ethylene oxide (Neodol 45-9), in a ratio of lower ethoxylate nonionic to higher ethoxylate nonionic of from about 1:1 to about 3:1; a mixture of the condensation product of $C_{10}$ alcohol with 3 moles of ethylene oxide together with the condensation product of a secondary $C_{15}$ alcohol with 9 moles of ethylene oxide (Tergitol 15-S-9), in a ratio of lower ethoxylate nonionic to higher ethoxylate nonionic of from about 1:1 to about 4:1; a mixture of Neodol 45-3 and Tergitol 15-S-9, in a ratio of lower ethoxylate nonionic to higher ethoxylate nonionic of from about 1:1 to about 3:1; and a mixture of Neodol 45-3 with the condensation product of myristyl alcohol with 10 moles of ethylene oxide, in a ratio of lower ethoxylate to higher ethoxylate of from about 1:1 to about 3:1.

Preferred nonionic surfactant mixtures may also contain alkyl glyceryl ether compounds together with the preferred alcohol ethoxylate surfactants. Particularly preferred are glyceryl ethers having the formula $$R^9—O(CH_2CH_2O)_nCH_2\underset{\underset{OH}{|}}{C}HCH_2OH$$

wherein $R^9$ is an alkyl or alkenyl group of from about 8 to about 18, preferably about 8 to 12, carbon atoms or an alkaryl group having from about 5 to 14 carbons in the alkyl chain, and n is from 0 to about 6, together with the preferred alcohol ethoxylates, described above, in a ratio of alcohol ethoxylate to glyceryl ether of from about 1:1 to about 4:1, particularly about 7:3. Glyceryl ethers of the type useful in the present invention are disclosed in U.S. Pat. No. 4,098,713, Jones, issued July 4, 1978; which is incorporated herein by reference.

The ratio of alkylpolyglycoside detergent surfactant to nonionic detergent surfactant is from about 10:1 to about 1:10, preferably from about 3:1 to about 1:3.

The Detergency Builder

The detergent compositions herein also contain from 0% to about 90%, preferably from about 5% to about 50%, and more preferably from about 10% to about 35% of a detergent builder. Such builders include, by way of example, a crystalline aluminosilicate ion exchange material of the formula $$Na_z[(AlO_2)_z.(SiO_2)_y].xH_2O$$

wherein z and y are at least about 6, the molar ratio of z to y is from about 1.0 to about 0.5 and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The preferred crystalline aluminosilicate ion exchange materials are further characterized by a particle size diameter of from about 0.1 micron to about 10 microns. Amorphous materials are often smaller, e.g., down to less than about 0.01 micron. More preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicates for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel, et al, issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27.

Other examples of detergency builders include water-soluble neutral or alkaline salts.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Preferred are the alkali metal, especially sodium, salts of the above.

Specific examples of inorganic phosphate builders are sodium and potassium tripolyphosphate, pyrophosphate, polymeric metaphate having a degree of polymerization of from about 6 to 21,.and orthophosphate. Examples of polyphosphonate builders are the sodium and potassium salts of ethylene-1,1-diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422.021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Water-soluble, nonphosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid.

Highly preferred polycarboxylate builders herein are set forth in U.S. Pat. No. 3,308,067, Diehl, issued Mar. 7, 1967 incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates of U.S. Pat. No. 3,723,322, Diehl incorporated herein by reference.

Other useful builders herein are sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000 for example), and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Other detergency builder materials useful herein are the "seeded builder" compositions disclosed in Belgian Pat. No. 798,856, issued Oct. 29, 1973, incorporated herein by reference. Specific examples of such seeded builder mixtures are: 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

Other Ingredients

In addition to the essential detergent surfactants described hereinbefore, the detergent compositions herein can contain from about 1% to about 15%, preferably from about 2% to about 8%, of an organic surfactant selected from the group consisting of anionic, zwitterionic, ampholytic, and cationic surfactants, and mixtures thereof. Surfactants useful herein are listed in U.S. Pat. No. 3,664,961, Norris, issued May 23, 1972, and U.S. Pat. No. 3,919,678, Laughlin et al, issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. The preferred soap, as discussed hereinbefore and hereinafter, especially in combination with semipolar or amide nonionic detergent surfactants, is at least partially unsaturated.

The Unsaturated Soap

The unsaturated fatty acid soap of this invention contains from about 16 to about 22 carbon atoms, preferably in a straight chain configuration. Preferably the number of carbon atoms in the unsaturated fatty acid soap is from about 16 to about 18.

The unsaturated soap, in common with other anionic detergent and other anionic materials in the detergent compositions of this invention, has a cation which renders the soap water-soluble and/or dispersible. Suitable cations include sodium, potassium, ammonium, monoethanolammonium, diethanolammonium, triethanolammonium, tetramethylammonium, etc. cations. Sodium ions are preferred although in liquid formulations ammonium, and triethanolammonium cations are useful.

A level of at least about 1% of the unsaturated fatty acid soap is desirable to provide a noticeable reduction in sudsing and corrosion. Preferred levels of unsaturated fatty acid soap are from about 1% to about 15%, preferably from about 1% to about 10%, most preferably from about 2% to about 5%. The unsaturated fatty acid soap is preferably present at a level that will provide a level of from about 15 ppm to about 200 ppm, preferably from about 25 ppm to about 125 ppm in the wash solution at recommended U.S. usage levels and from about 30 ppm to about 1000 ppm, preferably from about 50 ppm to about 500 ppm for European usage levels.

Mono-, di-, and triunsaturated fatty acids are all essentially equivalent so it is preferred to use mostly monounsaturated soaps to minimize the risk of rancidity. Suitable sources of unsaturated fatty acids are well known. For example, see Bailey's Industrial Oil and Fat Products, Third Edition, Swern, published by interscience Publisher (1964), incorporated herein by reference.

Preferably, the level of saturated soaps is kept as low as possible, preferably less than about 60%, preferably less than about 50% of the total soap is saturated soap. However, low levels of saturated soaps can be used. Tallow and palm oil soaps can be used.

Useful synthetic anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group.

Such synthetic anionic detergent surfactants are desirable additives at a level of from about 1% to about 10% to increase the overall detergency effect and, if desired, increase the level of suds. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Preferred anionic detergent surfactants are the alkyl polyethoxylate sulfates, particularly those in which the alkyl contains from about 10 to about 22 carbon atoms, preferably from about 12 to about 18 and wherein the polyethoxylate chain contains from about 1 to about 15 ethoxylate moieties preferably from about 1 to about 3 ethoxylate moieties. These anionic detergent surfactants are particularly desirable for formulating heavy-duty liquid laundry detergent compositions.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphtic substituent contains an anionic water-solubilizing group.

Zwitterionic surfactants include derivatives of aliphatic quaternary ammonium, phosphonium, and sulfonium compounds in which one of the aliphatic substituents contains from about 8 to 18 carbon atoms.

Particularly preferred auxiliary surfactants herein include linear alkylbenzene sulfonates containing from about 11 to 14 carbon atoms in the alkyl group; tallow-alkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; and alkyldimethylammonium propane sulfonates and alkyldimethylammonim hydroxy propane sulfonates wherein the alkyl group contains from about 14 to 18 carbon atoms.

Specific preferred surfactants for use herein include: sodium, potassium, mono-, di-, and triethanolammonium $C_{14-15}$ alkyl polyethoxylate$_{1-3}$ sulfates; sodium linear $C_{11-13}$ alkylbenzene sulfonate; triethanolamine $C_{11-13}$ alkylbenzene sulfonate; sodium tallow alkyl sulfate; sodium coconut alkyl glyceryl ether sulfonate; the sodium salt of a sulfated condensation product of a tallow alcohol with about 4 moles of ethylene oxide; 3-(N,N-dimethyl-N-coconutalkylammonio)-2hydroxypropane-1-sulfonate; 3-(N,N-dimethyl-N-coconutalkylammoniopropane-1-sulfonate; 6-(N-dodecylbenzyl-N,N-dimethylammonio)-hexanoate; and coconut alkyldimethyl amine oxide.

Other adjunct components which may be included in the compositions of the present invention, in their conventional art-established levels for use (i.e., from 0 to about 90%), include solvents, bleaching agents, bleach activators, soil-suspending agents, corrosion inhibitors, dyes, fillers, optical brighteners, germicides, pH adjusting agents (monoethanolamine, sodium carbonate, sodium hydroxide, etc.), enzymes, enzyme-stabilizing agents, perfumes, fabric softening components, static control agents, and the like.

Fatty acid amide detergent surfactants useful herein include those having the formula:

$$R^6-\overset{\overset{\displaystyle O}{\|}}{C}-NR_2^7$$

wherein $R^6$ is an alkyl group containing from about 7 to about 21 (preferably from about 9 to about 17) carbon atoms and each $R^7$ is selected from the group consisting of hydrogen, $C_{1-4}$ alkyl, $C_{1-4}$ hydroxy alkyl, and $-(C_2H_4O)_xH$ where x varies from about 1 to about 3.

Preferred amides are $C_{8-20}$ ammonia amides, monoethanolammonium, diethanolamides, and isopropanol amides.

A special advantage of the combination of detergent surfactants herein is their superior compatibility with anionic fluorescent or optical brighteners. Nonionic surfactants, especially ethoxylated nonionic detergent surfactants, normally diminish the effectiveness of such brighteners. With the addition of the alkylpolyglycoside surfactant, the brightener effectiveness is dramatically improved, especially on cotton. From about 0.01 to about 2%, preferably from about 0.1 to about 1% optical brightener can be used.

Suitable brighteners include the following:

bis anilino (R) triazinyl amino stilbene sulfonate having the formula:

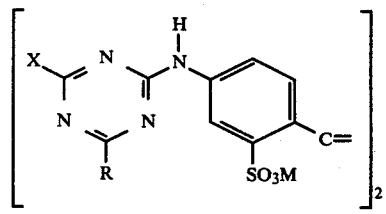

wherein M is preferably Na, but can be any compatible cation such as potassium, ammonium, substituted ammonium, e.g, mono-, di-, and triethanolammonium; etc.; X can be

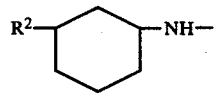

where $R^2$ is selected from H, phenyl, $C_{1-4}$ alkyl, or $C_{1-4}$ hydroxyalkyl; morpholino-, hydroxy;

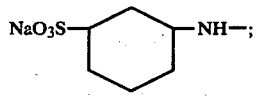

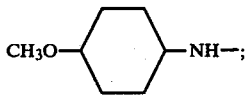

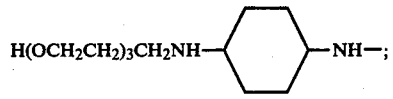

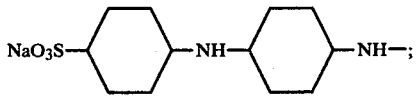

or mixtures thereof; and R can be H or $SO_3M$. In represented structures, R and X are:

| R | X |
|---|---|
| $-N(C_2H_4OH)_2$ | 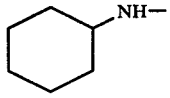 |

-continued

| R | X |
|---|---|
| 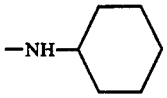 | " |
| $-NHCH_2CH_3$ | " |
| $-NHCH_2CHOHCH_3$ | " |
| 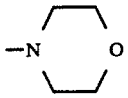 | " |
| $-NHC_2H_4OH$ | " |
| $-NH(CH_3)CH_2CH_2OH$ | " |
| $-NHC_3H_6OCH_3$ | " |
| $-NHC_2H_4OH$ | " |
| $-NHC_2H_4OCH_3$ | " |
| $-OH$ | " |
| $-NHC_2H_4OH$ | 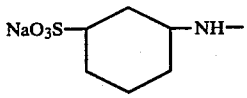 |
| 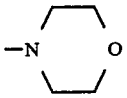 | 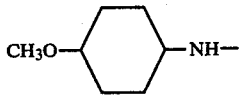 |
| $H(OCH_2CH_2)_3CH_2NH-$ | 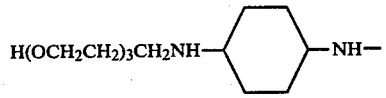 |
| $(HOCH_2CH_2)_2N-$ | 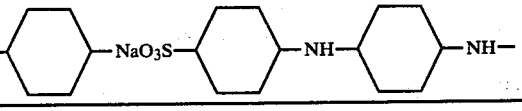 |

tetrasodium 4,4'-bis[(4''-bis(2'''-hydroxyethyl)amino-6''-(3''''-sulphenyl)amino-1'',3'',5''-triazin-2''-yl)amino]-2,2'-stilbenedisulfonate;

disodium-4-(6'-sulfonaphtho[1',2',d]triazol-2-yl)-2-stilbenesulfonate;

disodium 4,4'-bis[(4''-(2'''-hydroxyethylamino)-6''-anilino-1'',3'',5''-triazin-2''-yl)amino]-2,2'-stilbenedisulfonate;

disodium 4,4'-bis[(4''-(2'''-hydroxyethoxy)-6''-anilino-1'',3'',5''-triazin-2''-yl)amino]-2,2'-stilbenedisulfonate;

disodium 4,4'-bis(4-phenyl-1,2,3-triazol-2-yl)-2,2'-stilbenedisulfonate;

sodium 4-(2H-naphtho[1,2-d]triazol-2-yl)stilbene-2-sulfonate;

disodium 4,4'-bis-(2-sulfostyryl)biphenyl;

disodium 4-(2H-6-sulfonaphtho[1,2-d]triazol-2-yl)stilbene-2-sulfonate; and disodium 3,7-bis(2,4-dimethoxybenzamido)-2,8-dibenzothiophenedisulfonate-5,5-dioxide.

Other suitable brighteners are disclosed in U.S. Pat. Nos. 3,537,993 Coward et al; issued Nov. 3, 1970 and 3,953,380 Sundby, issued Apr. 27, 1976, incorporated herein by reference.

The compositions of the present invention can be manufactured and used in a variety of forms such as solids, powders, granules, pastes, and liquids. The compositions can be used in the current U.S. laundering processes by forming aqueous solution containing from about 0.01% to about 1%, preferably from about 0.05% to about 0.5%, and most preferably from about 0.05% to about 0.25% of the composition in water and agitating the soiled fabrics in that aqueous solution. The fabrics are then rinsed and dried. When used in this manner the preferred compositions of the present invention yield exceptionally good detergency on a variety of fabrics.

In a preferred embodiment a laundry detergent, preferably, an aqueous heavy-duty liquid, contains (a) from about 1% to about 20% (preferably from about 4% to about 10%) of the alkylpolyglycoside detergent surfactant; (b) from about 1% to about 10% (preferably from about 2% to about 6%) of an amine oxide detergent surfactant (c) from 1% to about 10% (preferably from about 1% to about 6%) of a water-soluble soap of an unsaturated fatty acid containing from about 16 to about 22 carbon atoms; (d) from 0% to about 40% (preferably from about 10% to about 30%) of a water-soluble detergency builder, preferably selected from the group consisting of pyrophosphates, nitrilotriacetates, and mixtures thereof; (e) from about 0% to about 10% (preferably from about 0% to about 5%) of water-soluble synthetic anionic detergent surfactant; and, preferably, and (f) the balance water and being substantially free, preferably completely free, of zeolite detergent builders.

Such detergent compositions provide excellent detergency, do not damage washing machines unacceptably, and can be formulated to provide different sudsing patterns by varying the amount and types of synthetic anionic detergent surfactant and the amount of unsaturated soap. Preferably such formulas do not contain more than about 5% conventional ethoxylated nonionic surfactants. Sodium, potassium, ammonium, and alkanolammonium cations are preferred.

All percentages, parts, and ratios herein are by weight unless otherwise specified.

The following examples illustrate the compositions and method of the present invention.

EXAMPLE I

| Unbuilt Combination of | | Hunter Whitness Units (HWU) Clay Removal | | |
|---|---|---|---|---|
| $C_{12-15}$ alkyl polyglycosides$_{2-3}$ | $C_{12-13}$ alkyl polyethoxylate$_{6.5}$ ppm in Wash | Cotton | Polyester Cotton Blend (Polycotton) | Polyester |
| 500 | — | 9.4 | 15.4 | 2.9 |
| 400 | 100 | 6.4 | 15.5 | 4.6 |
| 300 | 200 | 6.3 | 17.1 | 7.1 |
| 200 | 300 | 4.4 | 17.6 | 7.1 |
| 100 | 400 | 2.7 | 16.3 | 7.1 |
| — | 500 | −0.3 | 15.6 | 6.8 |

Test Condition: 95° F. water having 6 grains of mixed hardness and a miniwasher.

As can be seen from the above results, the alkylpolyglycoside surfactant has an unexpected problem with cleaning polyester. In general, the alkylpolyglycosides are considered nonionic surfactant replacements, but, surprisingly, they achieve their best laundry results in combination with nonionic surfactants, especially those that are optimized for cleaning relatively hydrophobic surfaces. The alkyl polyglycosides in these examples were derived from glucose. Similar results are obtained with the other alkyl glycosides described herein.

EXAMPLE II

| (Unbuilt Mixtures) | | |
|---|---|---|
| $C_{12-15}$ alkyl polyglycosides$_{2-3}$ | $C_{12-13}$ alkyl polyethoxylate$_3$ | % Dirty Motor Oil Removal from Polyester Fabrics |
| 300 ppm | 0 ppm | 10 |
| 240 ppm | 60 ppm | 20 |
| 180 ppm | 120 ppm | 27 |
| 0 ppm | 300 ppm | 17 |

Same conditions as in Example I.

As can be seen from the above data, despite the generally inferior results obtained in cleaning relatively hydrophobic surfaces with an alkylpolyglycoside surfactant, the mixtures of an alkylpolyglycoside and a nonionic surfactant provides synergistic results.

EXAMPLE III

| Whiteness Maintenance (Redeposition Test) | | | | |
|---|---|---|---|---|
| | $C_{12-13}$ alkyl | Hunter Whiteness Units (HWU) | | |
| $C_{12-15}$ alkyl polyglycoside$_{2-3}$ | polyethoxylate$_3$ Neodol 23-3 | White Cotton T-shirt | White Polycotton | White Polyester |
| 300 ppm | 0 | 73 | 68 | 36 |
| 240 ppm | 60 | 74 | 70 | 39 |
| 180 ppm | 120 | 79 | 73 | 40 |
| 60 ppm | 240 | 73 | 73 | 39 |
| 0 | 300 | 71 | 73 | 39 |

The solutions were unbuilt and used the same conditions as Examples I and II, the grades being the average for the two types of soils.

As can be seen from the above data, there is a synergistic improvement in redeposition on cotton for the mixtures of surfactants.

EXAMPLE IV

| $C_{12-15}$ alkyl polyglycoside$_{2-3}$ | $C_{12-13}$ alkyl polyethoxylate$_3$ | % Menstrual Stain Removal from polycotton |
|---|---|---|
| 300 ppm | 0 | 50 |
| 240 ppm | 60 | 60 |
| 180 ppm | 120 | 63 |
| 60 ppm | 240 | 70 |
| 0 ppm | 300 | 63 |

Same test conditions as in previous examples with unbuilt solutions.

As can be seen from the above, the unexpectedly poor showing of the alkylpolyglycoside with respect to this stain can be improved and/or synergistic improvement obtained by addition of the nonionic surfactant, depending upon the ratio used.

EXAMPLE V

| Built Performance on Clay Soil | | | |
|---|---|---|---|
| | Hunter Whiteness Units (HWU) | | |
| | Cotton | Polycotton | Polyester |
| Commercial built anionic detergent composition | 11.0 | 19.9 | 22.5 |
| $C_{12-15}$ alkylpolyglycoside$_{2-3}$ + $C_{12-13}$ alkylpolyethoxylate$_{6.5}$ 1:1 ratio* | 12.7 | 21.2 | 26.3 |

*Built with 25% sodium tripolyphosphate (STP) and 10% sodium carbonate, the total composition being used at a level of 1200 ppm.

Test Condition: 60° F. water having 9 grains of mixed hardness and miniwasher.

As can be seen from the above the mixed surfactant system of this invention provides equivalent or superior clay removal across a variety of fabric types as compared to more conventional anionic surfactants.

EXAMPLE VI

| | $C_{12-15}$ alkyl polyglycosides$_{2-3}$ + coconut alkyl dimethylamine oxide (1:1) | $C_{12-13}$ alkyl polyethoxylate$_{6.5}$ + Coconut alkyl dimethylamine oxide (1:1) |
|---|---|---|
| Clay Removal, HWU | | |
| Cotton | 14.6 | 11.2 |

-continued

| | $C_{12-15}$ alkyl polyglycosides$_{2-3}$ + coconut alkyl dimethylamine oxide (1:1) | $C_{12-13}$ alkyl polyethoxylate$_{6.5}$ + Coconut alkyl dimethylamine oxide (1:1) |
|---|---|---|
| Polycotton | 28.5 | 22.1 |
| Polyester | 59.0 | 55.2 |
| Removal, % | | |
| Dirty motor oil | 30 | 37 |
| Chocolate syrup | 93 | 93 |
| Grass | 67 | 73 |
| Bacon grease | 57 | 53 |
| Menstrual stain | 83 | 73 |
| Spaghetti sauce | 50 | 67 |
| Body Soil Revoval, PSU* vs. Commercial Unbuilt Heavy-Duty Liquid (Control) | +1.56 | +1.7 |
| Whiteness, Soler 2A | | |
| T-shirt | 78 | 77 |
| Polycotton | 86 | 85 |
| Polyester | 46 | 39 |

The surfactant mixture was 13% of the formula and the builder was sodium nitrilotriacetate at 18%. The test conditions were 2100 ppm of the composition, 95° F., 6 grains of mixed hardness.

EXAMPLE VII

Unbuilt HDL Performance

The invention vs. unbuilt commercial heavy-duty liquid detergent composition (HDL).

| Panel Score Units vs. Commercial Product | Cotton | Polyester |
|---|---|---|
| Dirty mortor oil | +0.3 | +0.4 |
| Bacon grease | +1.0 | +0.8 |
| Gravy | +1.4 | +0.2 |
| Spaghetti sauce | +0.3 | +0.9 |
| Grass | +1.7 | +1.5 |
| Chocolate syrup | −0.4 | +0.6 |

TEST CONDITION: 450 ppm actives, 95° F. water having 6 grains mixed hardness and a mini washer.

Composition of the invention: $C_{12-13}$ alkylpolyethoxylate$_3$/$C_{12-15}$ alkylpolyglycoside$_{2-3}$ at a ratio of 1:1.

EXAMPLE VIII

| | Formula Parts |
|---|---|
| $C_{12-15}$ alkylpolyglycoside$_{2-3}$ | 13.3 |
| $C_{12-13}$ alkylpolyethoxylate$_{6.5}$ | 13.3 |
| Sodium tripolyphosphate | 12.0 |
| $Na_2CO_3$ | 13.3 |
| Polyacetaldehyde detergency builder | 28.8 |
| Anionic brightener* | 1.0 |

*bis(anilino-hydroxyethylmethylamino-triazinylamino)stilbene disulfonate (sodium salt).

| | Fluorescer Effectiveness | | | |
|---|---|---|---|---|
| | Filtered HWU | Unfiltered HWU | Delta F | Soler 2A |
| $C_{12-15}$ alkylpolyglycoside$_{2-3}$/Neodol 23-6.5 | 79 | 111 | 22 | 87 |
| Commercial built anionic detergent (control) | 80 | 106 | 19 | 80 |

Significant technical differences: HWU=2; Soler 2A=2; and F=1.

EXAMPLE IX

Redeposition and Whiteness/Brightness Test

Cotton T-Shirt

The following results using unbuilt mixtures of surfactants clearly demonstrate the effect of the alkylpolyglycoside in improving anionic brightener effectiveness in the presence of nonionic surfactants. The data show clearly that at least about 40% of the surfactant system should be alkylpolyglycoside. Five to six HWUs are a substantial improvement.

| | | Unfiltered* Hunter Whiteness Units | | |
|---|---|---|---|---|
| $C_{12-13}$ alkyl-polyglycoside$_{2-3}$ | $C_{12-13}$ alkyl-polyethoxylate$_3$ | Before Washing | After Washing | Delta (loss) |
| 100 | 0 | 120 | 110 | 10 |
| 80 | 20 | 122 | 113 | 9 |
| 60 | 40 | 118 | 109 | 9 |
| 20 | 80 | 119 | 92 | 27 |
| 0 | 100 | 118 | 91 | 27 |

*To measure brightener effect

Conditions: Miniwasher, 6 grains mixed hardness, 100° F., one cycle 300 ppm total surfactant, 15 ppm of the brightener of Example VIII.

EXAMPLE X

The alkylpolyglycosides improve the performance of very water soluble (high HLB) nonionics.

| Ratio | | Clay Cleaning Performance Hunter Whiteness Units | | |
|---|---|---|---|---|
| $C_{12-13}$ alkyl-polyglycoside$_{2-3}$ | $C_{12-13}$ alkyl-polyethoxylate$_{12}$ | Polyester | Polycotton | Cotton |
| 100 | 0 | 25.9 | 2.8 | 1.2 |
| 80 | 20 | 27.0 | 3.3 | 2.5 |
| 60 | 40 | 28.8 | 5.2 | 3.6 |
| 20 | 30 | 29.1 | 5.0 | 4.2 |
| 0 | 100 | 28.1 | 2.2 | 2.1 |

Conditions: Miniwasher, unbuilt, 6 grains at mixed hardness, 100° F., 300 ppm total active.

As can be seen from the above data, the mixtures are clearly superior. From 1 to 2 HWU are a substantial difference in this test.

EXAMPLE XI

Alkyl Polyglucosides Improve the Performance of Oil Soluble (Low HLB) Nonionic Detergent Surfactants

| Ratio | | (HWU) Clay Removal from | | (P.S.U.) Lipid Facial Soil Removal |
|---|---|---|---|---|
| $C_{12-13}$ alkyl-polyglycoside$_{2-3}$ | $C_{12-13}$ alkyl polyethoxylate$_3$ | Polyester | Cotton | from Polycotton |
| 100 | 0 | 23.9 | 0.8 | 0.2 |
| 80 | 20 | 24.9 | −0.1 | 0.5 |
| 60 | 40 | 24.6 | −11.9 | 0.6 |
| 20 | 80 | 8.8 | −21.0 | −0.4 |
| 0 | 100 | −0.8 | −27.8 | −0.9 |

Conditions: Miniwasher, Unbuilt, 6 grains mixed hardness, 100° F., 300 ppm. ($LSD_{95}$=1.2 HWU for clay and $LSD_{95}$=0.4 P.S.U. for facial soil.)

Clearly, the above results show the improvement from mixing conventional (ethoxylated) nonionic detergent surfactants with alkylpolyglycosides. The mixtures provide a substantial improvement in detergency.

EXAMPLE XII

Combinations of alkyl polyglucosides and semi-polar nonionic and/or amide detergent surfactants are compatible with unsaturated soap, but not with saturated soap.

| | Formula | | | | |
|---|---|---|---|---|---|
| | 1 | 2 | 3 | 4 | 5 |
| $C_{12-13}$ alkylpolyglycoside$_{2-3}$ | 7.3 | 7.3 | 7.3 | 7.3 | 7.3 |
| $C_{12-15}$ alkyldimethylamine oxide | 3.3 | 3.3 | 3.3 | 3.3 | 3.3 |
| Sodium oleate | 2.2 | — | — | — | 4.4 |
| Sodium tallowate | — | 2.2 | — | — | — |
| Sodium stearate | — | — | 4.4 | — | — |
| Sodium $C_{14-15}$ alkyl polyethoxylate 2.25 sulfate | 1.45 | 1.45 | — | 2.9 | — |
| Coconut diethanolamide | 0.13 | 0.13 | 0.25 | 0.13 | 0.25 |
| Sodium nitrilotriacetate | 18.2 | 18.2 | 18.2 | 18.2 | 18.2 |
| Sodium carbonate | 2.8 | 2.8 | 2.8 | 2.8 | 2.8 |
| Sodium toluene sulfonate | 2 | 2 | 2 | 2 | 2 |
| Ethyl alcohol | 3 | 3 | 3 | 3 | 3 |
| Water | | | Balance | | |

Compositions 1–3 and 5 were lower sudsing than formula 4 and were more compatible with washing machine surfaces (less corrosive). Composition 3 formed an unsightly soap scum in the rinse water despite the presence of materials known to inhibit formation of such scums. Composition 3 also formed a thick gel rather than a free flowing, clear liquid. It is clear that there must not be a substantial excess of saturated soap over unsaturated. The soap must be at least about 40% unsaturated soap.

It has additionally been discovered that the performance of these compositions is improved if the total free fatty alcohol containing from about 8 to about 20 carbon atoms is less than about 5%, preferably less than about 2%, most preferably less than about 1%.

Know analytical techniques can be used to determine the structures of the alkylpolysaccharide surfactants herein; for example, to determine the glycosidic chain length, the amount of butyl glucoside, the free fatty alcohol content, and the level of unreacted polysaccharide. More specifically, gas or liquid chromatography can be used to determine the unreacted alcohol content and the unreacted polysaccharide content respectively. Proton nmr can be used to determine the average glycosidic chain length. The point of attachment of the hydrophilic portion of the molecule to the hydrophobic portion of the molecule can be determined by $^{13}C$ nmr.

The alkylpolysaccharide surfactants are complex mixtures. Their components vary depending upon the nature of the starting materials and the reaction by which they are prepared. Analytical standards which are useful in calibrating instruments for analyzing the components of a particular alkylpolysaccharide surfactant can be obtained from Calbiochem Behring Co. LaJolla, Calif. These standards include those for octylglucoside (Calbiochem #494559), decylglucoside (Calbiochem #252715), dodecylmaltoside (Calbiochem #3243555).

Alkylpolysaccharide surfactants having the structures specified in the claims and characterized by one or more of the standard analytical techniques will give the results indicated in the examples.

For best performance in removing clay the nonionic surfactant should be one prepared by reacting ethylene oxide with a hydrophobic base and preferably the ratio of the alkyl polysaccharide to the nonionic should be greater than about 1:1. Semipolar nonionic detergent surfactants such as amine oxides are not good for clay removal.

For best anionic brightener (fluorescer) performance the ratio of alkyl polysaccharide to nonionic detergent surfactant should be greater than about 1:1. The alkylpolysaccharide will improve anionic brightener performance in the presence of semipolar detergent surfactants such as amine oxides.

What is claimed is:

1. A detergent composition comprising:

(A) from about 1% to about 90% of an alkylpolysaccharide detergent surfactant of the formula $RO(R'O)_y(Z)_x$ where R is an alkyl, hydroxy alkyl, alkyl phenyl, hydroxy alkyl phenyl, alkyl benzyl, or mixtures thereof, said alkyl groups containing from about 8 to about 18 carbon atoms; where each R' contains from 2 to about 4 carbon atoms and y is from 0 to about 12; and where each Z is a moiety derived from a reducing saccharide selected from the group consisting of glucose, galactose and mixtures thereof, and x is a number from about 1½ to about 3;

(B) from about 1% to about 90% of a nonionic detergent surfactant;

(C) from 0% to about 90% of a detergency builder, the ratio of (A) to (B) being from about 1:1 to about 10:1, and (D) from about 0.01% to about 2% of an anionic optical brightener.

2. The composition of claim 1 wherein Component (A) has the formula $$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof, t is from 0 to about 12, and x is from about 1½ to about 3.

3. The composition of claim 2 wherein the nonionic surfactant has an HLB of from about 5 to about 17 and the anionic optical brightener is present in an amount from about 0.1 to about 1%.

4. The composition of claim 1 wherein the anionic optical brightener is selected from the group consisting of:

bis anilino (R) triazinyl amino stilbene sulfonate having the formula:

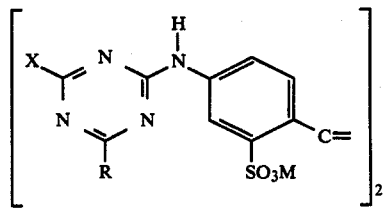

wherein M is potassium, ammonium, substituted ammonium, or mixtures thereof; and R and X are:

| R | X |
|---|---|
| $-N(C_2H_4OH)_2$ | 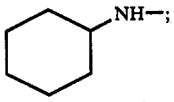 |
| 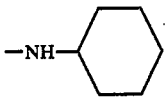 | " ; |
| $-NHCH_2CH_3$ | " ; |
| $-NHCH_2CHOHCH_3$ | " ; |
| 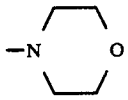 | " ; |
| $-NHC_2H_4OH$ | " ; |
| $-N(CH_3)CH_2CH_2OH$ | " ; |
| $-NHC_3H_6OCH_3$ | " ; |
| $-NHC_2H_4OH$ | " ; |
| $-NHC_2H_4OCH_3$ | " ; |
| $-OH$ | " ; |
| $-NHC_2H_4OH$ | 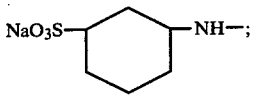 |
| 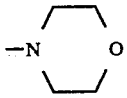 | 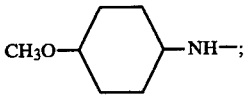 |
| $H(OCH_2CH_2)_3CH_2NH-$ | 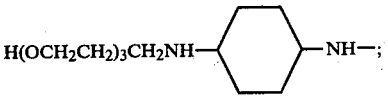 |
| $(HOCH_2CH_2)_2N-$ | 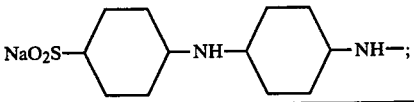 |

tetrasodium 4,4'-bis[(4''-bis(2'''-hydroxyethyl)amino-6''-(3''''-sulphenyl)amino-1'',3'',5''-triazin-2''-yl)amino]-2,2'-stilbenedisulfonate;

disodium-4-(6'-sulfonaphtho[1',2',d]triazol-2-yl)-2-stilbenesulfonate;

disodium 4,4'-bis[(4''-(2'''-hydroxyethylamino)-6''-anilino-1'',3'',5''-triazin-2''-yl)amino]-2,2'-stilbenedisulfonate;

disodium 4,4'-bis[(4''-(2'''-hydroxyethoxy)-6''-anilino-1'',3'',5''-triazin-2''-yl)amino]-2,2'-stilbenedisulfonate;

disodium 4,4'-bis(4-phenyl-1,2,3-triazol-2-yl)-2,2'-stilbenedisulfonate;

disodium 4,4'-bis-(2-sulfostyryl)biphenyl;

sodium 4-(2H-naphtho[1,2-d]triazol-2-yl)stilbene-2-sulfonate;

disodium 4-(2H-6-sulfonaphtho[1,2-d]triazol-2-yl)stilbene-2-sulfonate; and disodium 3,7-bis(2,4-dimethoxybenzamido)-2,8-dibenzothiophenedisulfonate-5,5-dioxide and mixtures thereof.

5. The composition of claim 4 wherein the ratio of (A) to (B) is from about 1:1 to about 3:1.

6. The composition of claim 1 wherein the detergency builder is present at a level of from about 20% to about 50% and is selected from the group consisting of hydrated Zeolites A, X, and P, having a particle size of from about 0.01 to about 10 microns, alkali metal ammonium or substituted ammonium tripolyphosphates, pyrophosphates, carbonates, silicates, borates, polymeric metaphosphates, nitrilotriacetates, citrates, and polyacetal carboxylates and mixtures thereof.

7. The composition of claim 1 wherein the nonionic surfactant has an HLB of from about 5 to about 17 and the anionic optical brightener is present in an amount from about 0.1 to about 1%.

8. The composition of claim 6 wherein Component (A) has the formula $$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof, t is from 0 to about 12, and x is from about $1\frac{1}{2}$ to about 3.

9. The composition of claim 8 wherein the anionic optical brightener is selected from the group consisting of:

bis anilino (R) triazinyl amino stilbene sulfonate having the formula:

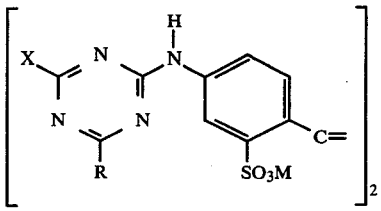

wherein M is potassium, ammonium, substituted ammonium, or mixtures thereof; and R and X are:

| R | X |
|---|---|
| $-N(C_2H_4OH)_2$ | 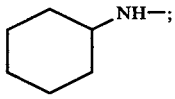 |
| 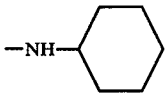 | " ; |
| $-NHCH_2CH_3$ | " ; |
| $-NHCH_2CHOHCH_3$ | " ; |
| 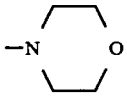 | " ; |
| $-NHC_2H_4OH$ | " ; |
| $-N(CH_3)CH_2CH_2OH$ | " ; |
| $-NHC_3H_6OCH_3$ | " ; |
| $-NHC_2H_4OH$ | " ; |
| $-NHC_2H_4OCH_3$ | " ; |
| $-OH$ | " ; |
| $-NHC_2H_4OH$ | 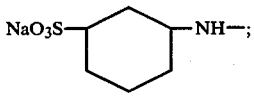 |
| 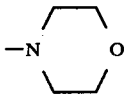 | 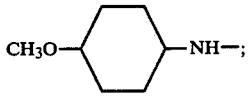 |
| $H(OCH_2CH_2)_3CH_2NH-$ | 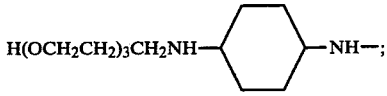 |
| $(HOCH_2CH_2)_2N-$ | 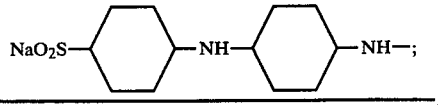 |

tetrasodium 4,4'-bis[(4''-bis(2'''-hydroxyethyl)amino-6''-(3''''-sulphenyl)amino-1'',3'',5''-triazin-2''-yl)amino]-2,2'-stilbenedisulfonate;

disodium-4-(6'-sulfonaphtho[1',2',d]triazol-2-yl)-2-stilbenesulfonate;

disodium 4,4'-bis[(4''-(2'''-hydroxyethylamino)-6''-anilino-1'',3'',5''-triazin-2''-yl)amino]-2,2'-stilbenedisulfonate;

disodium 4,4'-bis[(4''-(2'''-hydroxyethoxy)-6''-anilino-1'',3'',5''-triazin-2''-yl)amino]-2,2'-stilbenedisulfonate;

disodium 4,4'-bis(4-phenyl-1,2,3-triazol-2-yl)-2,2'-stilbenedisulfonate;

disodium 4,4'-bis-(2-sulfostyryl)biphenyl;

sodium 4-(2H-naphtho[1,2-d]triazol-2-yl)stilbene-2-sulfonate;

disodium 4-(2H-6-sulfonaphtho[1,2-d]triazol-2-yl)stilbene-2-sulfonate; and disodium 3,7-bis(2,4-dimethoxybenzamido)-2,8-dibenzothiophenedisulfonate-5,5-dioxide and mixtures thereof.

* * * * *